United States Patent [19]

Grieb

[11] 4,247,139

[45] Jan. 27, 1981

[54] SANITARY WASTE COLLECTOR

[76] Inventor: Geoffrey E. Grieb, 789 W. End Ave., New York, N.Y. 10025

[21] Appl. No.: 949,855

[22] Filed: Oct. 10, 1978

[51] Int. Cl.[3] ..... A01K 29/00

[52] U.S. Cl. ..... 294/1 BA

[58] Field of Search ..... 294/1 B, 1 BA, 1 BB, 294/15, 19 R, 99 R, 100, 115

[56] References Cited

U.S. PATENT DOCUMENTS

| | | | |
|---|---|---|---|
| 3,733,098 | 5/1973 | Tobias | 294/1 BA |
| 3,738,697 | 6/1973 | Kahan | 294/1 BA |
| 4,014,584 | 3/1977 | Bau | 294/1 BA |
| 4,056,278 | 11/1977 | Bau et al. | 294/1 BA |

*Primary Examiner*—Johnny D. Cherry

*Attorney, Agent, or Firm*—Gottlieb, Rackman & Reisman

[57] ABSTRACT

There is disclosed a sanitary waste collector particularly useful for picking up pet feces. The collector includes a handle which moves a disposable container from an open condition, where the container is placed over the pet feces, to a closed condition, where the container scoops up the pet feces. The container is loaded into the handle from a stack of containers and is thereafter ejected from the handle for purposes of disposal, after the container has been sealed.

22 Claims, 15 Drawing Figures

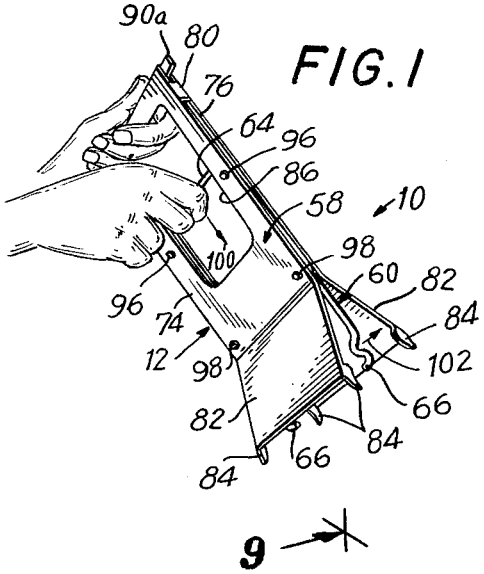
FIG. 1
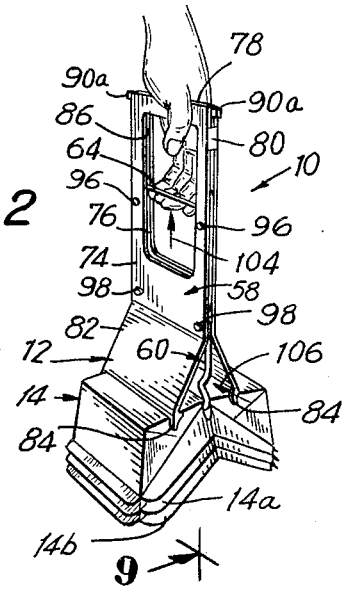
FIG. 2
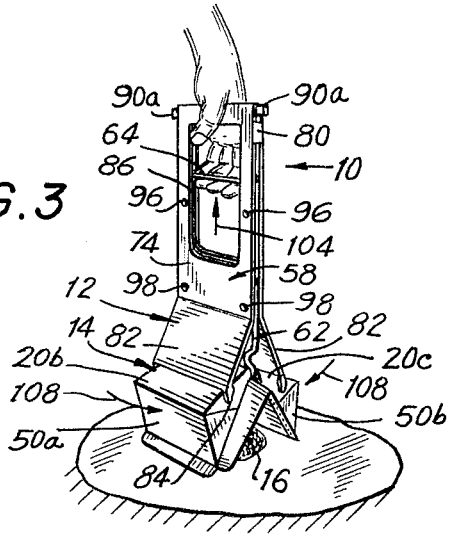
FIG. 3
FIG. 4
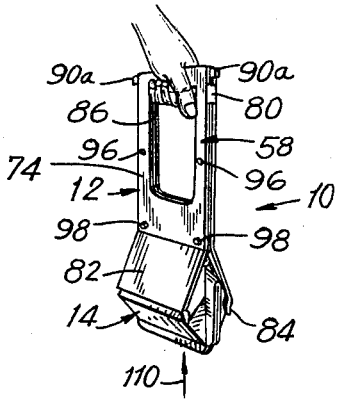
FIG. 5
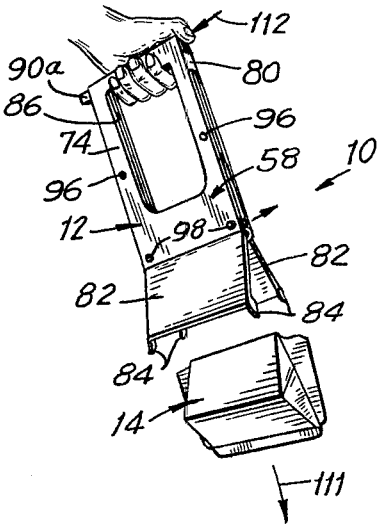

SANITARY WASTE COLLECTOR

The present invention relates generally to sanitary waste collectors and, more particularly, to a sanitary waste collector for picking up pet feces or other material to be disposed of.

Various sanitary waste collectors for picking up pet feces have been proposed. Although these devices have sometimes involved mechanical tools which are positioned over the feces and then are manipulated to close the jaws or similar elements to contain the feces, these devices have suffered from several disadvantages.

For example, these prior art devices have not generally provided a disposable receptacle or container for the droppings. Moreover, some of these prior art devices have also had the further disadvantage of getting soiled, after the device has been put to repeated use.

Certain prior art devices have attempted to overcome these problems and disadvantages, by utilizing bags or other containers attached to the arms or jaws of a device. However, these devices have also been less than satisfactory. For example, most of the disposable containers have had to be attached manually to the device or have required manual ejection. In those cases where "automatic" ejection has been attempted, the devices have been unduly complex, thereby increasing manufacturing costs; they have also been difficult to use, and have not worked properly.

It is thus a broad object of the present invention to provide a sanitary waste collector, particularly useful in picking up pet feces, which overcomes the drawbacks and disadvantages of prior art devices.

A more specific object of the invention is to provide a sanitary waste collector for picking up pet feces, which utilizes a disposable container which may be loaded in the device, without the user having to touch the container.

Yet another object of the present invention is to provide a sanitary waste collector for picking up pet feces in a disposable container, where the container may be conveniently ejected from the device.

Still another object of the present invention is to provide a sanitary waste collector for picking up pet feces, which has relatively few moving parts, can be manufactured relatively inexpensively and which is not prone to breakdown or malfunction.

These and other objects of the present invention are obtained by providing a sanitary waste collector for picking up pet feces. The collector utilizes a disposable container movable by a handle from an open condition, when said container is placed over the pet feces, to a closed and sealed condition, for scooping up the pet feces. The handle includes a frame and gripping means for releasably engaging the container. The gripping means is movable relative to the frame between a lower position and an upper position. During this movement, camming means causes the gripping means to move sequentially between a container-receiving mode, a container-gripping mode and a container-releasing mode. The frame also includes means for causing the container to close as the gripping means moves from its lower position toward its upper position.

In operation, the camming means initially causes the gripping means to move to its container-receiving mode as the gripping means is moved to its lower position, and a disposable container is loaded into the handle, preferably from an inverted stack of similar containers.

As the gripping means is moved upwardly, the camming means causes the gripping means to move to the container-gripping mode; and the container, in its open condition, is lowered by the handle over the pet feces. Further movement of the gripping means upwardly causes the jaws of the container to close around the droppings, thereby "scooping up" the droppings. As the jaws close, adhesive edges in the container come together to maintain the droppings within the container. When the gripping means reaches its upper position, the camming means moves the gripping means to its container-releasing mode and the sealed container is ejected from the handle.

The above brief description of the present invention will be more readily appreciated by reference to the following detailed description of a presently preferred, but nonetheless illustrative embodiment of the invention, when taken in conjunction with the following drawings, wherein:

FIG. 1 is a perspective view showing the handle of the sanitary waste collector according to the present invention, with the gripping means in its lower position and in its container-receiving mode;

FIG. 2 is a perspective view similar to that of FIG. 1, but showing the gripping means being moved upwardly from its lower position so that the gripping means is in its container-gripping mode and further showing the gripping means engaging a container from an inverted stack of containers;

FIG. 3 is a perspective view similar to that of FIG. 2, but showing further travel of the gripping means from its lower position toward its upper position and showing the disposable container moved by the handle from its open condition toward its closed condition;

FIG. 4 is a perspective view similar to that of FIG. 3, but showing the disposable container in its closed and sealed condition;

FIG. 5 is a perspective view similar to that of FIG. 4, but showing the gripping means in its upper position and in its container-releasing mode, and further showing the disposable container being ejected from the handle;

Figure 12:
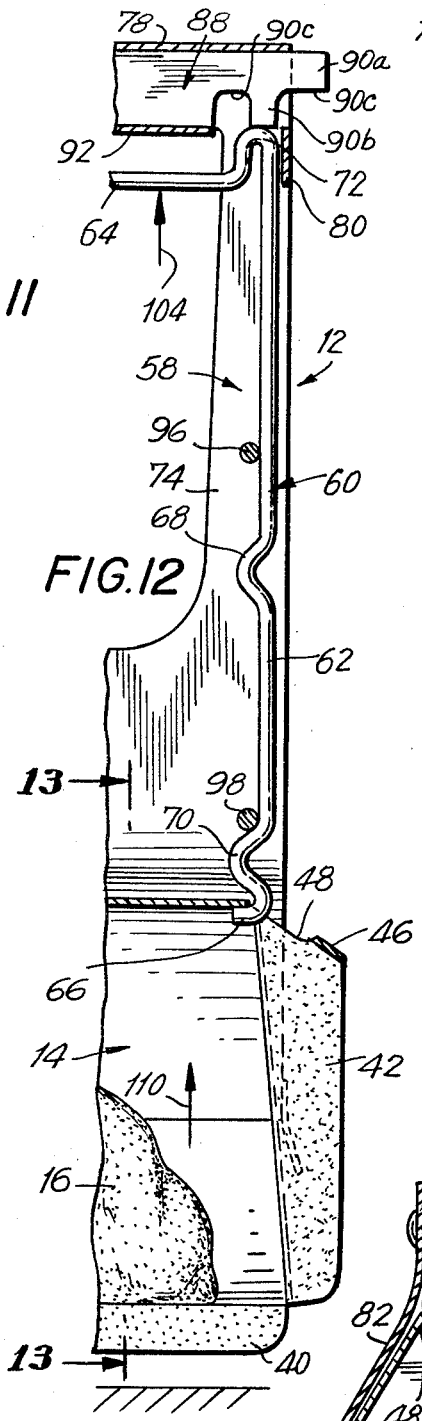
FIG. 12 is a front elevation view similar to that of FIG. 11, but showing the gripping means in an intermediate position prior to reaching its upper position, and further showing the disposable container being closed by the handle.
Figure 14:
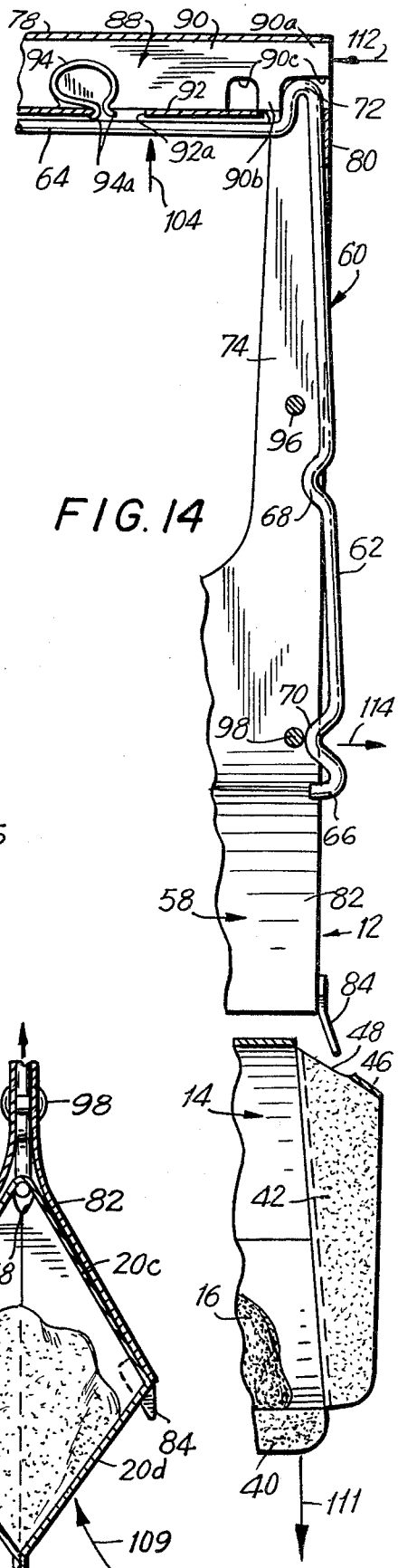
Figure 13:
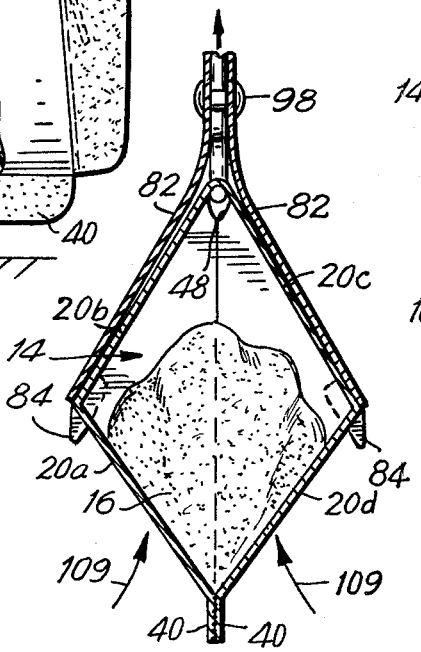

FIG. 13 is a sectional view taken along the line 13—13 of FIG. 12 and looking in the direction of the arrows, and showing the disposable container in its sealed condition; and FIG. 14 is a front elevation view similar to that of FIG. 12, but showing the gripping means in its upper position and in its container-releasing mode, and further showing the disposable container being ejected from the handle.

Referring to the drawings and, more particularly, to FIGS. 1–5 thereof, a sanitary waste collector particularly useful in picking up pet feces or other waste material which is located on the ground, is generally designated 10. Collector 10 includes a handle, generally designated 12, which selectively engages a disposable container 14, the latter being transferred, under control of the handle, from an open condition when the container is placed over pet feces 16 or other waste material (see FIG. 3), to a closed and sealed condition, where the container encloses the droppings (see FIGS. 4 and 13). Thereafter, and as will be explained, the handle 12 ejects container 14 (see FIG. 5), so that the pet feces 16 can be disposed of in a sanitary manner within the container.

Figure 6:
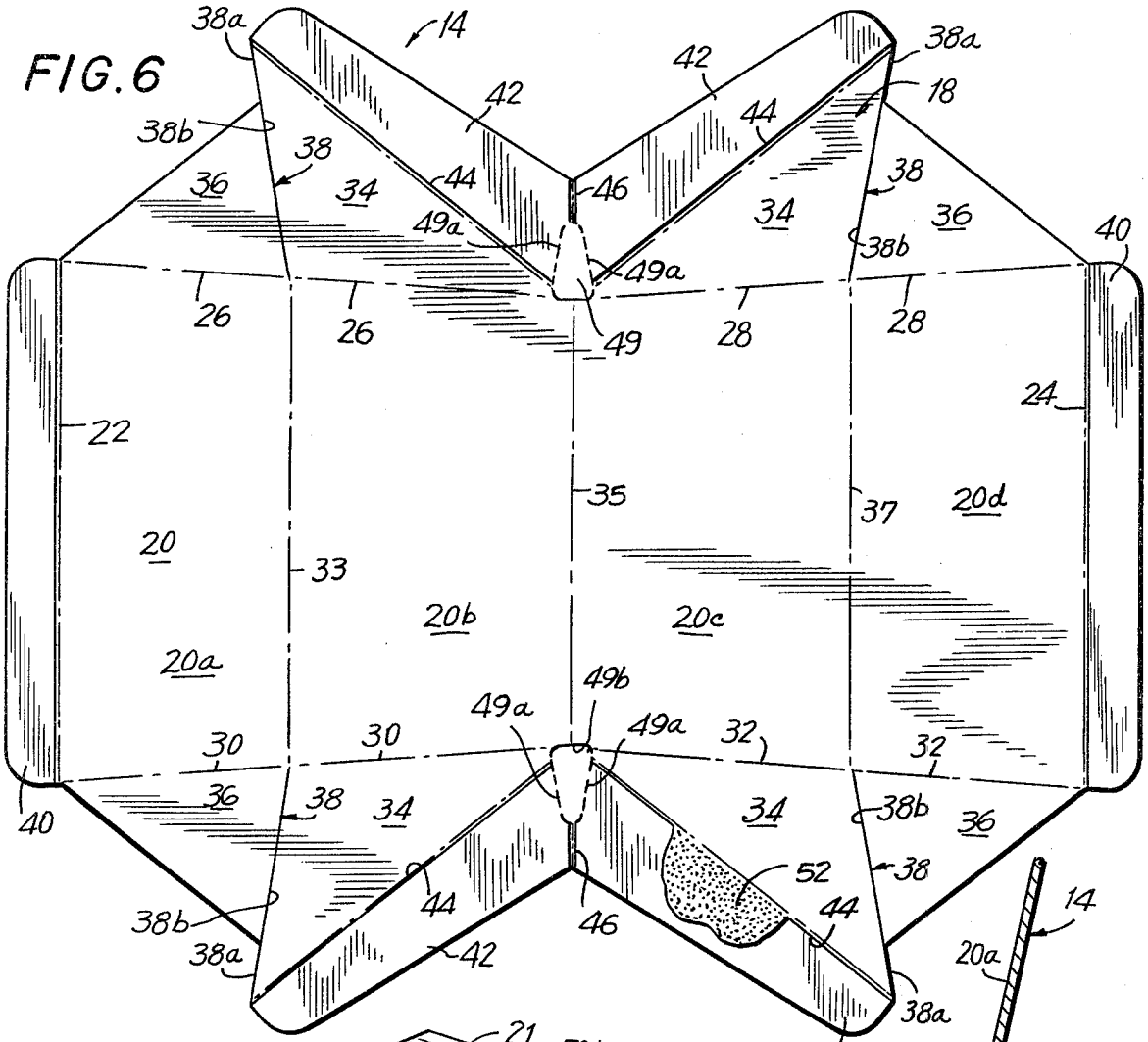
FIG. 6 is a top plan view showing a "blank" used to form a disposable container according to one embodiment of the present invention.
Figure 7:
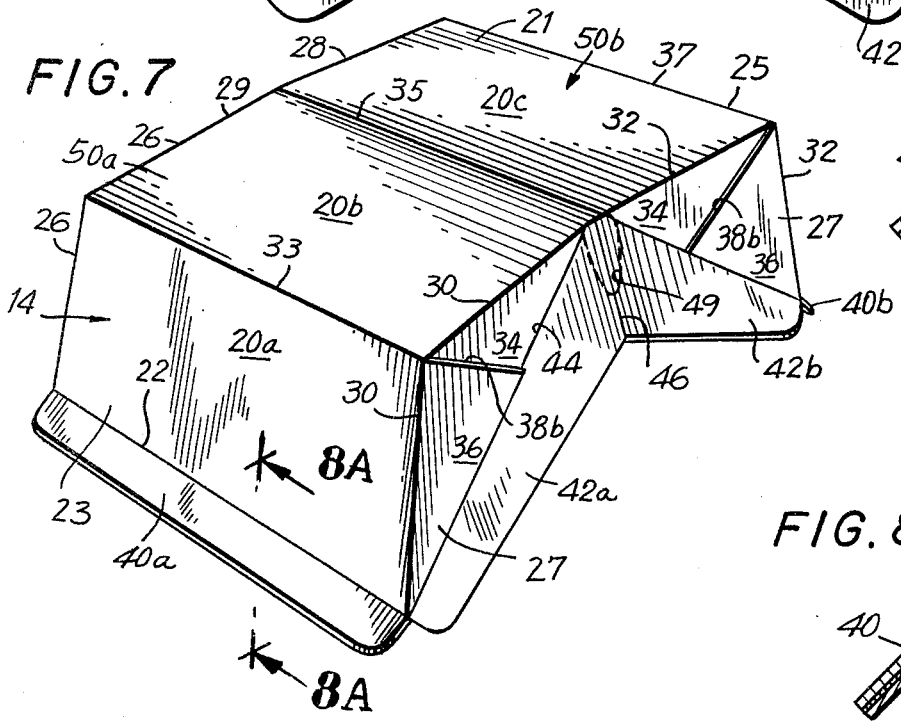
FIG. 7 is a perspective view showing a disposable container formed from the blank of FIG. 6.
Figure 8A:
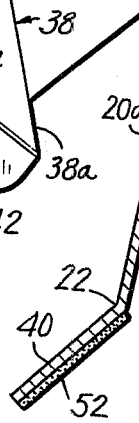
FIG. 8A is a sectional view, taken along the line 8A-8A of FIG. 7 and looking in the direction of the arrows.

The constructional details of container 14 are shown in FIGS. 6, 7 and 8A. In particular, container 14 is formed from a "blank" 18 of cardboard or similar material having the shape shown in FIG. 6. Although other materials can be used, standard 16 point "paperboard" has been found to be a particularly satisfactory material.

Blank 18 is formed to include a substantially rectangular portion 20 defined by edges 22 and 24 and by fold lines 26, 28, 30 and 32. Additional fold lines 33, 35 and 37, divide rectangular panel 20 roughly into quarter sections corresponding to container panels 20*a*, 20*b*, 20*c* and 20*d*. Container blank 18 further includes triangular sections 34 which extend from panels 20*b* and 20*c* at fold lines 26, 28, 30 and 32, respectively. Additional triangular sections 36 extend outwardly from fold lines 26, 28, 30 and 32 at container panels 20*a* and 20*d*. It should be noted that container blank 18 is slit or cut along lines 38 from the outer periphery of container blank 18 up to the fold lines 26, 28, 30 and 32, thereby separating triangular sections 34 from triangular sections 36 at edges 38*a* and 38*b*, respectively. This enables the triangular sections 36 to be folded over and secured to the triangular sections 34, when container 14 is formed from the container blank.

Container 14 is further formed from container blank 18 with end sealing flaps 40, and with side sealing flaps 42. Two end sealing flaps 40 are provided, one extending from edge 22 and the other extending from edge 24 of the container and four side sealing flaps 42 are provided, with each flap 42 extending from triangular sections 34, at edges 44.

In order for handle 12 to grasp the disposable container 14, the container has two aligned handle-receiving cut-outs 48, of generally triangular shape (see FIG. 10), located at fold line 46 and along the center fold line 35. The cut-outs 48 are formed from triangular tabs 49 (see FIG. 6). Each tab 49 has legs 49*a* of a perforated construction and a third leg 49*b* which acts as a fold line for the tab. When the handle grasps the container, tabs 49 are punched inwardly by the handle, the perforations along legs 49*a* tear, and the tabs fold back along lines 49*b*, thereby providing the cut-out openings 48. The tabs 49, when in their folded-back condition, also prevent the handle from damaging the container, by reinforcing the container at the areas where it is grasped by the handle.

The disposable container formed from the container blank 18 is illustrated in FIG. 7, with the disposable container folded from container blank 18 so as to provide two jaws 50*a* and 50*b*, which close about center fold line 35. The container 14 is maintained in its assembled condition, shown in FIG. 7, by folding the container blank along fold lines 33 and 37, by overlapping triangular sections 34 and 36 and by securing, by glue, paste or other means, the triangular sections 34 to the triangular sections 36.

Thus, when the container is formed, it has a top wall 21, consisting of panels 20*b* and 20*c*, which is bisected by fold line 35; a first end wall 23 consisting of panel 20*a*; a second end wall 25 consisting of panel 20*d*; a first side wall 27; and a second side wall 29, opposite the first side wall. As shown in FIG. 7, first end sealing flap 40*a* is located at first end wall 23, second end sealing flap 40*b* is located at second end wall 25, first side sealing flap 42*a* and second side sealing flap 42*b* are located at first side wall 27, and third and fourth sealing flaps (not shown in FIG. 7) are located at second side wall 29.

In order for the container 14 to be sealed so that the pet feces may be maintained therein, the undersides of end sealing flaps 40 and the undersides of side sealing flaps 42 are advantageously coated with a latex adhesive 52 (see FIGS. 6 and 8A), of the type manufactured by Schwartz Chemical Co., Inc. of Long Island City, New York, and identified as "Rez 'n Glue No. 123". This adhesive is of the type which sticks or adheres only to itself, so that when the jaws 50*a* and 50*b* of disposable container 14 are closed by handle 12 and the undersides of the end sealing flaps 40 come into contact with each other and the undersides of the side sealing flaps 42 come into contact with each other, a seal or closure for the disposable container is provided; except for such contact, flaps 40 and 42 do not adhere to other elements.

In particular, when the first end sealing flap 40*a* (located at the bottom of first end wall 23) contacts the second end sealing flap 40*b* (located at the bottom of second end wall 25), these sealing flaps adhere; when the first side sealing flap 42*a* (located at the first side wall 27) contacts the second side sealing flap 42*b* (also located at first side wall 27), these sealing flaps adhere; and when the third and fourth sealing flaps (located at the second side wall 29) make contact, these sealing flaps adhere.

Figure 8B:
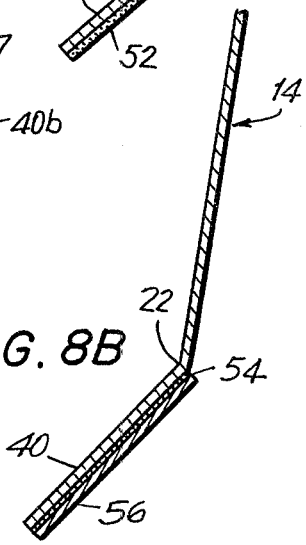
FIG. 8B is a sectional view similar to that of FIG. 8A, but showing a disposable container according to an alternative embodiment of the present invention.

According to an alternative embodiment of the container of the present invention, illustrated in FIG. 8B, the undersides of the end and side sealing flaps 40 and 42 are provided with a layer of adhesive 54, normally covered by a protective cover strip 56. According to this embodiment, when the disposable container 14 is ready for use, the strips 56 are peeled away, exposing the adhesive layers 54 so that when jaws 50*a* and 50*b* are closed, the end and side sealing flaps adhere to each other, respectively, thereby sealing the container.

The disposable container 14 is moved from its open condition to its closed and sealed condition by handle 12 which includes a frame, generally designated 58, and means for releasably engaging the container, in the form of a wire element 60 which is moved by a user relative to frame 58 from a lower position, where the gripping means is in a container-receiving mode (see FIG. 1), to an intermediate position, where the gripping means is in a container-gripping mode (see FIGS. 2–4), and ultimately to an upper position, where the gripping means is in a container-releasing mode (see FIG. 5).

Figure 9:
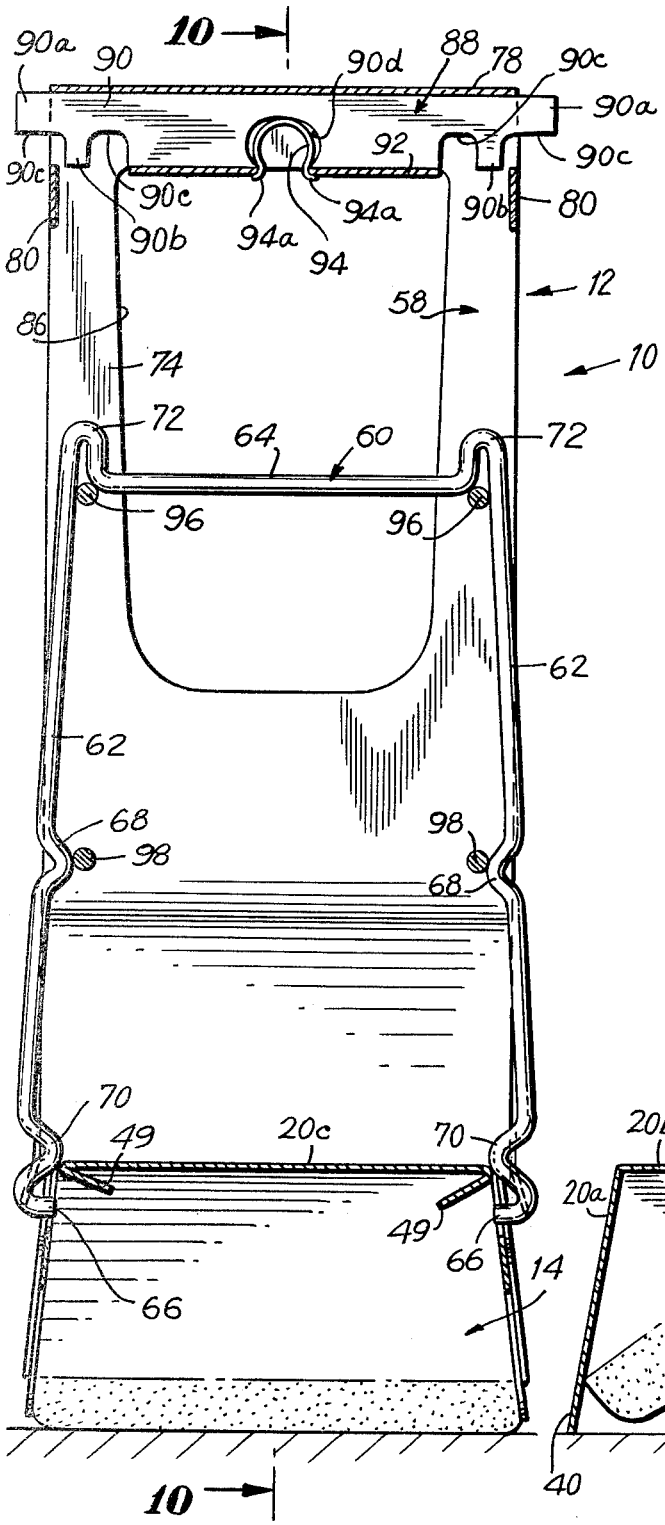
FIG. 9 is a front elevation view of the sanitary waste collector of the present invention, with part of the handle removed and showing the gripping means in its lower position and ready to receive a disposable container.

In considering the structure of collector 10, gripping means 60 is shown in FIG. 9 as having an inverted U-shape, and includes two downwardly-directed legs 62 which are connected together by a horizontal actuating bar 64. Each leg 62 of the gripping means terminates at an inwardly-directed container-gripping end 66. As will be explained, as the legs 62 of gripping means 60 flex, the container-gripping ends 66 are moved toward and away from each other in order to selectively engage th container 14 at the handle-receiving cut-outs 48 of the container. In order to facilitate this movement, it is advantageous for the gripping means 60 to be of steel or such other material which not only allows legs 62 to repeatedly flex outwardly in order to release the containers, but which also enables the legs to return to their unflexed position so that the containers are grasped by ends 66.

The legs 62 of gripping means 60 are flexed outwardly by camming means which operates as the gripping means is moved relative to frame 58. Thus, the legs 62 of the gripping means 60 are provided with two pairs of inwardly-directed projections which function as cam followers. Specifically, each leg 62 has a first cam follower 68 which, by flexing leg 62 outwardly, causes outward movement of the container-gripping ends 66 when the gripping means is moved to its lower position. Each leg 62 also includes a second cam follower 70, located just above the container-gripping end 66. Each of the second cam followers similarly causes outward flexing of the legs 62 and, therefore, outward movement of the container-gripping ends 66. This movement occurs when the gripping means is moved to its upper position.

Gripping means 60 also includes upwardly bent projections 72, located at the juncture of actuating bar 64 and each of the legs 62. Projections 72 cooperate with gate means, to be described, which causes the gripping means to selectively move into its upper position, for ultimate release of the filled and sealed container.

As indicated, gripping means 60 is moved relative to frame 58; and frame 58 has opposed frame faces 74 which define a channel 76 (see FIG. 10) in which the gripping means moves. The frame faces are connected at their upper ends by an upper frame wall 78 and, to add rigidity to frame 58, are also connected by side tabs 80. The lower ends of each frame face 74 are bent outwardly, thereby providing guides 82 which serve to close the disposable container 14. Frame 58 is preferably formed from sheet steel and is of a gauge sufficient to allow the guides 82 to have some degree of flexing. This flexing is desirable, so that in the final phase of upward travel, the gripping means 60 does not tear the disposable container at the container's handle-receiving cut-outs 48 (see FIGS. 6, 7), as the container is moved upwardly by handle 12. As indicated, the tabs 49 which form the cut-outs 48 also prevent tearing of the container, by reinforcing the container in the area where the container is grasped by ends 66. The lower end of the frame 58 terminates in four guide tabs 84 which function to prevent side-to-side movement of the disposable container 14, as the container is closed by handle 12 and during the subsequent ejection process.

Each frame face 74 further defines a hand-receiving opening 86 shown, for example, in FIG. 1. This opening in frame 58 enables the user of the sanitary waste collector to grip the actuating bar 64 of the gripping means 60, in order to move the gripping means upwardly or downwardly, depending on the desired operation of the device.

In addition to frame 58 and gripping means 60, handle 12 further includes gate means 88, located near the top of the handle, for selectively preventing the gripping means 60 from reaching its upper position. The gate means includes a slide 90 which is located within a channel formed by upper frame wall 78 and a frame wall 92, the latter located at the top of the hand-receiving opening 86. Slide 90 extends outwardly from each side of frame 58 at slide ends **90*a* and is further formed to include downwardly-extending projections 90*b* which are adapted to abut the upwardly-bent projections 72 of the gripping means 60, thereby normally preventing the gripping means from reaching its upper position until such time as the projections 90*b* of slide 90 are moved out of the way. When this occurs, further upward movement of the gripping means 60 is allowed, with the gripping means then stopping when the projections 72 engage shoulders 90*c*, adjacent each of the projections 90*b***.

As shown in FIG. 9, gate means 88 also includes biasing means, in the form of a spring clip 94, which fits within a notch **90*d* in slide 90, with the ends 94*a* of the spring clip engaging a cut-out 92*a* of frame wall 92. Thus, the spring clip normally biases the slide 90 in the position illustrated in FIG. 9, where the projections 90*b* are in a position to abut projections 72 of the gripping means, thereby preventing the gripping means from reaching its upper position (see FIG. 12**).

Finally, handle 12 includes a series of rivet-like elements 96 and 98 connected between the frame faces 74 of frame 58. The two uppermost elements 96, besides adding rigidity to the frame 58, serve as stop means for preventing downward movement of the gripping means 60 past its lower position. This is accomplished by having elements 96 located so as to abut actuating bar 64 as the gripping means reaches its lower position (see FIG. 9). The two lowermost elements 98, while also providing rigidity to the frame 58, also serve as the cams for controlling the flexing of legs 62 of the gripping means. Both elements 96 and elements 98 also act as guides for gripping means 60, retaining the gripping means within the frame 58 and preventing the legs 62 from flexing too far inwardly. It will be appreciated, that although elements 96 and 98 have been described as of a rivet-like construction, these elements may be differently formed, for example, they may be formed of inward depressions in each face 74 of frame 58 which are spot welded together, they may be screw elements, etc., thereby providing the same function, i.e., acting as guides for the gripping means, adding rigidity to the frame and either service as stops or as cams for the gripping means.

In operation, handle 12 is used to close disposable container 14, according to the following description of a typical operational sequence.

Initially, the user of the sanitary waste collector, grasping the frame 58 of handle 12 in one hand, as shown in FIG. 1, grasps the actuator bar 64 with his other hand, and moves the gripping means 60 downwardly relative to frame 58 in the direction of arrow 100 of FIG. 1. The gripping means 60 is moved in the direction of arrow 100 until the gripping means reaches its lower position. In this position, illustrated in FIGS. 1 and 9, further movement of the gripping means in the direction of arrow 100 is prevented by abutment of actuator bar 64 and elements 96.

As gripping means 60 reaches its lower position, camming means, consisting of first cam followers 68 and cams 98, causes the legs 62 of the gripping means to flex outwardly. This results in movement of the container-gripping ends 66 of the gripping means in the direction of arrow 102, also shown in FIG. 1. As the gripping means reaches its lower position, the gripping means assumes its container-receiving mode (see FIG. 9) and is in a position to receive a disposable container 14 since gripping ends 66 are in their outward position.

Figure 10:
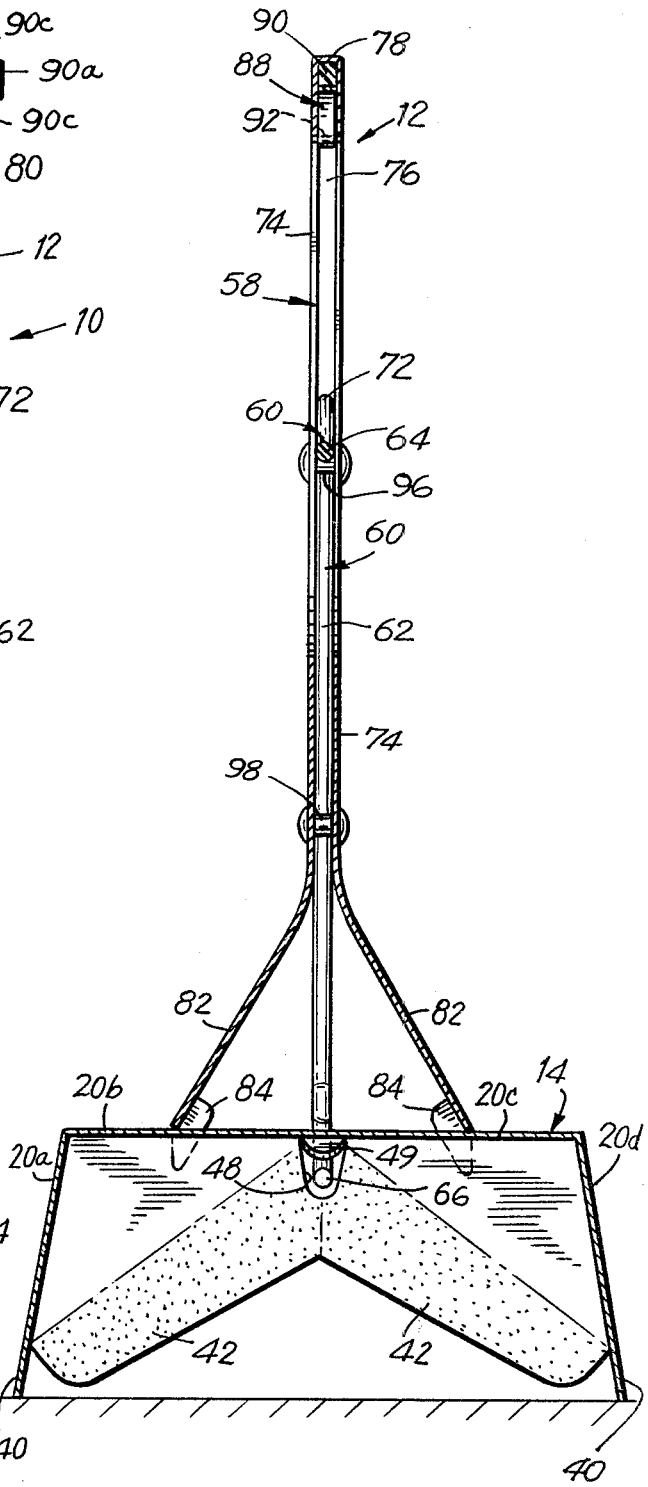
FIG. 10 is a sectional view, taken along the line 10—10 of FIG. 9 and looking in the direction of the arrows.

As illustrated in FIG. 2, the disposable container 14 may be loaded into handle 12 from a stack of inverted containers 14, 14*a* and 14*b*, with the number of containers in the stack being a matter of choice. In his discretion, the user may desire to load the disposable container 14 separately, that is, without the container resting in a stack of similar containers. In loading containers 14, handle 12 is placed on container 14 such that guide tabs 84 are to each side of the container. The guide tabs thus serve to "center" the disposable container relative to the handle, while also preventing the container from moving in a side-to-side direction as the container is lifted up. In addition, the gripping ends 66 of gripping means 60 should be in alignment with the tabs 49 of the handle-receiving cut-outs 48 of the container, as the container is ready to be loaded into the handle. The position of the handle 12 relative to container 14 as the container is loaded, is shown in FIGS. 2 and 10.

With the handle 12 in this position, the user then grasps actuator bar 64 of the gripping means and starts to move the gripping means upwardly relative to frame 58, i.e., in the direction of arrow 104 of FIG. 2. For efficient operation, the user grasps bar 64 with his fingertips, so that the sanitary waste collector may be operated substantially in a one-hand manner (see FIG. 2).

Figure 11:
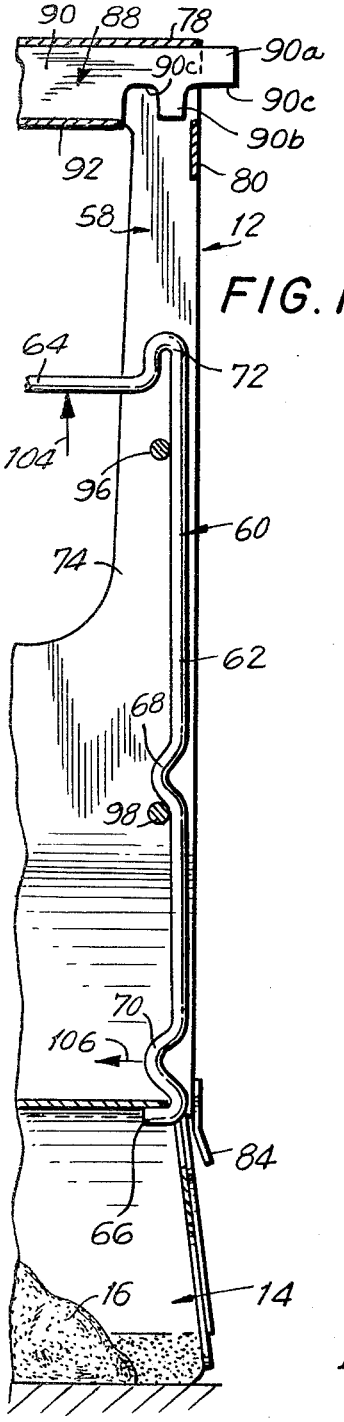
FIG. 11 is a partial front elevation view similar to that of FIG. 9, but showing the gripping means being moved from its lower position toward its upper position and with the gripping means in its container-gripping mode.

Movement of the gripping means upwardly in the direction of arrow 104 from its lower position, causes cam follower 68 to "clear" cam 98, as illustrated in FIG. 11. This results in an inward flexing of legs 62 of the gripping means, thereby causing the gripping ends 66 to move inwardly, in the direction of arrow 106 of FIGS. 2 and 11. This causes the container-gripping ends to engage container 14, at cut-outs 48, with the gripping ends 66 "punching in" the tabs 49 of the cut-outs. Thus, as the gripping means 60 is moved upwardly from its lower position, the camming means causes the gripping means to move into a container-gripping mode, such that the container is engaged by the handle of the device.

At the beginning of the container-gripping mode, container 14, although it has been grasped by the gripping means 60, is still in an open condition, somewhat similar to that of container 14 shown in FIG. 2. In this open condition, the jaws 50*a*, 50*b* of the container are open, thereby enabling the container to be placed over an amount of waste, for example pet feces 16, located on the ground or other similar surface.

Having so positioned container 14 about the feces by the use of handle 12, the user moves the gripping means 60 upwardly, in the direction of arrow 104 of FIG. 3. Such movement of the gripping means causes the jaws 50*a*, 50*b* of container 14 to start to close. This closing action, initially resulting from the action of the bottom of guide faces 82 of frame 58 on the container panels 20*b* and 20*c*, causes the jaws to move in the direction of arrows 108 of FIG. 3. Movement of the jaws in this direction causes the feces 16 to be scooped up by container 14.

Container 14 reaches its closed condition when the gripping means 60 reaches the position, relative to frame 58, illustrated in FIGS. 4 and 12, and the container 14 has been drawn up into handle 12. As this occurs, the guides 82 of frame 58 urge the jaws 50*a* and 50*b* toward a closed position, as shown by arrow 109 in FIG. 13. Moreover, the guides 82 force the end sealing flaps 40 and the side sealing flaps 42 together, such that not only is the container 14 closed, but it is also sealed, to maintain the pet feces 16 within the container.

Referring to FIG. 12, it will also be appreciated that, although container 14 has been closed and sealed, the gripping ends 66 of gripping means 60 still hold the container within the guide 82 of frame 58. With the container so in place, the user then lifts up handle 12 (and container 14) from the ground level (see arrow 110 of FIGS. 4 and 12), so that the sealed container can be transported by handle 12 to a location convenient for the user to eject the container from the handle, as shown by arrow 111 of FIGS. 5 and 14.

In order to insure that the container 14 is not ejected from handle 12 prematurely, gate means 88 prevents the gripping means 60 from reaching its upper (and ejection) position, until such time as the gate means is actuated. Specifically, and as indicated in FIG. 12, the gripping means 60 is prevented from going into its container-releasing mode by the projections 90*b* which abut the projections 72 of the gripping means. When it is desired to release container 14 from handle 12, the user, for example with his thumb shown in FIG. 5, depresses one or the other of slide ends 90*a*, causing slide 90 to move either in the right-to-left direction or the left-to-right direction, relative to frame 58.

By a comparison of FIGS. 12 and 14, it will be appreciated that movement of slide 90, for example in the right-to-left direction as indicated by arrow 112 of FIG. 14, causes the slide projections 90*b* to move out of the path of travel of the gripping means projections 72. This enables the user, by exerting pressure on gripping means 60 in the direction of arrow 104, to move the gripping means to its upper position, illustrated in FIG. 14.

In its upper position, projections 72 of the gripping means, having cleared projections 90*b* of the slide, move to a position where the projections 72 abut the shoulders 90*c* to the right of slide projection 90*b*. (It will be appreciated that had slide 90 been moved in the left-to-right direction, the projections 72, after having cleared the slide projections 90*b*, would abut the shoulders 90*c* located to the left of projections 90*b*, as the gripping means is moved to its upper position. In this way, the gate means may be depressed either by a user's right thumb or left thumb depending, of course, on which hand grasps handle 12.)

As the gripping means reaches its upper position, cam 98 rides along the second cam follower 70, thereby causing the legs 62 of gripping means 60 to move outwardly once again, in the direction of arrow 114, illustrated in FIG. 14. This outward movement causes the gripping means to move to its container-releasing mode and ends 66 of the gripping means release the container 14, so that the container may be disposed of in an appropriate receptacle.

It will be appreciated, therefore, that the present invention provides a sanitary waste collector which overcomes several disadvantages of the prior art. For example, the device has relatively few moving parts and, therefore, is not only not prone to malfunction, but may be constructed relatively inexpensively. Moreover, the invention provides a sanitary waste collector which may be operated by a user in a relatively easy fashion and, to a great extent, operated with only one hand. Still further, the waste within the container 14 is disposed of in a sanitary fashion with the handle 12 rarely, if ever, getting soiled, despite repeated use of the device.

Although the invention has been described with reference to particular embodiments, it is to be understood that these embodiments are merely illustrative of the application of the principles of the invention. For example, although the frame and gripping means have been described as being of steel, and the disposable container of paperboard, it will be appreciated that other materials may be used. Still further, although the invention has particular applicability in picking up pet droppings, it may readily be used or modified to pick up other types of waste. Thus, numerous modifications may be made therein and other arrangements may be devised, without departing from the spirit and scope of the present invention.

What is claimed is:

1. A sanitary waste collector for picking up waste comprising a disposable container movable from an open condition when said container is placed over the waste to a closed condition for scooping up the waste, and a handle for moving said container from its open condition to its closed condition, said handle including a frame and further including gripping means for releasably engaging said container and movable relative to said frame between a lower position and an upper position, camming means for moving said gripping means between a container-receiving mode, a container-gripping mode and container-releasing mode, and means defined by said frame for causing said container to close as said gripping means moves from its lower position toward its upper position.

2. A sanitary waste collector according to claim 1, wherein said camming means causes said gripping means to move to its container-receiving mode when said gripping means is in its lower position, causes said gripping means to move to its container-gripping mode as said gripping means is moved from its lower position toward its upper position, and causes said gripping means to move to its container-releasing mode when said gripping means reaches its upper position.

3. A sanitary waste collector according to claim 2, wherein said handle further includes gate means for selectively preventing said gripping means from reaching its upper position.

4. A sanitary collector according to claim 3, wherein said gate means defines an abutment for engaging said gripping means, said gate means movable from a first position where said abutment contacts said gripping means and prevents said gripping means from reaching its upper position, to a second position where said abutment moves out of contact with said gripping means and allows said gripping means to reach its upper position.

5. A sanitary waste collector according to claim 4, wherein said gate means includes means for normally biasing said gate means in its first position.

6. A sanitary waste collector according to claim 5, wherein said gate means includes a slide and said means for biasing said gate means is a spring which biases said slide in its first position.

7. A sanitary waste collector according to claim 2, wherein the frame defines a hand-receiving opening and at least part of said gripping means is disposed in the hand-receiving opening enabling the gripping means to be grasped by a user for moving the gripping means relative to said frame.

8. A sanitary waste collector according to claim 2, wherein the frame includes two opposed frame faces.

9. A sanitary waste collector according to claim 8, wherein said frame faces include diverging guide faces.

10. A sanitary waste collector according to claim 9, wherein said means for causing the container to close as said gripping means moves from its lower position toward its upper position includes said diverging guide faces.

11. A sanitary waste collector according to claim 10, wherein said frame faces include guide tabs for preventing side-to-side movement of the container relative to the frame.

12. A sanitary waste collector according to claim 2, wherein said camming means includes a first cam follower carried by said gripping means, a second cam follower carried by said gripping means and a cam element defined in said handle, said gripping means moving to its container-receiving mode when said first cam follower passes over said cam element and moving to its container-releasing mode when said second cam follower passes over said cam element.

13. A sanitary waste collector according to claim 12, wherein said handle further includes means for limiting travel of said gripping means, when said gripping means reaches its lower position.

14. A sanitary waste collector according to claim 12, wherein said gripping means is generally U-shaped and includes legs connected by an actuator bar.

15. A sanitary waste collector according claim 14, wherein said legs each terminate at one of their ends at inwardly-directed gripping ends, said gripping ends engaging said disposable container when said gripping means is in its container-gripping mode.

16. A sanitary waste collector according to claim 15, wherein said camming means causes inward or outward flexing of said legs.

17. A sanitary waste collector according to claim 16, wherein said camming means causes said gripping ends to move outwardly when said gripping means is in its container-receiving mode and in its container-releasing mode.

18. A sanitary waste collector according to claim 17, wherein said first cam follower and said second cam follower are inwardly-directed indentations defined in each of said legs.

19. A sanitary waste collector according to claim 2, wherein said disposable container has jaws, said handle moving said jaws from an open position to a closed position.

20. A sanitary waste collector according to claim 19, wherein said disposable container further includes means for sealing said jaws closed, when said container reaches its closed position.

21. A sanitary waste collector according to claim 20, wherein said disposable container defines an aperture at each side thereof for receiving the gripping means.

22. A sanitary waste collector for picking up pet feces comprising a disposable container movable from an open condition where said container is placed over the pet feces to a closed condition for scooping up said pet feces, said container including means for sealing the container when said container reaches its closed condition, and a handle for moving said container from its open condition to its closed condition, said handle including a frame and further including U-shaped gripping means for releasably engaging said container and including container-receiving ends movable between outward positions wherein said gripping means is in either a container-receiving mode or a container-releasing mode and inwardly-directed positions wherein said gripping means is in a container-gripping mode, camming means including a first cam follower for causing the gripping means to move to its container-receiving mode when said gripping means is in its lower position and further including a second cam follower for causing said gripping means to move to its container-releasing mode when said gripping means is in its upper position, diverging guide feces defined by said frame for causing said container to move from its open condition to its closed condition as said gripping means carries said container and moves from its lower position toward its upper position, and gate means normally biased in a first position for preventing said gripping means from reaching its upper position, said gate means movable to enable said gripping means to reach its upper position for ejection of said container.

* * * * *